US005463924A

United States Patent [19]

Reuterfors

[11] Patent Number: 5,463,924

[45] Date of Patent: Nov. 7, 1995

[54] REPOSITIONABLE TUNING PEG

[76] Inventor: Aldor E. Reuterfors, 1801 Wisteria, Rockford, Ill. 61107

[21] Appl. No.: 340,535

[22] Filed: Nov. 16, 1994

[51] Int. Cl.[6] ..... G10D 3/14

[52] U.S. Cl. ..... 84/304

[58] Field of Search ..... 84/304, 305

[56] References Cited

U.S. PATENT DOCUMENTS

| | | | |
|---|---|---|---|
| 2,558,059 | 6/1951 | Nyhagen | 84/304 |
| 4,005,628 | 2/1977 | Darling | 84/304 |
| 5,388,491 | 2/1995 | John | 84/304 |

*Primary Examiner*—Patrick J. Stanzione

[57] ABSTRACT

A tuning peg for tuning a stringed instrument. The inventive device includes a tapered shaft for receiving one of the instrument strings thereabout. A thumb piece is coupled to the tapered shaft by an adjustable angle coupler which permits the thumb piece to be selectively orientated at a desired rotational angle relative to the tapered shaft. By this structure, the thumb pieces of the instrument can all be positioned at a desired orientation. In order to make the tuning peg more durable and reliable in its construction, the end of the tapered shaft which the thumb piece is connected to is fitted with a shaft including a circular plate and mounting stud construction. The shaft insert has a threaded interior bore that gives a more firm connection between the thumb piece and the tapered shaft.

6 Claims, 2 Drawing Sheets

REPOSITIONABLE TUNING PEG

BACKGROUND OF THE INVENTION

1. Field of the Invention

The present invention relates to tuning devices, and more particularly pertains to a repositionable tuning peg for tuning a stringed instrument.

2. Description of the Prior Art

The use of tuning devices is known in the prior art. More specifically, tuning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art tuning devices include U.S. Pat. Nos. 4,367,671; 3,830,132; 5,018,424; 4,674,387; 4,077,295; and 4,827,825.

While these devices fulfill their respective, particular objectives and requirements, the aforementioned patents do not disclose a tuning peg for tuning a stringed instrument which includes a tapered shaft for receiving one of the instrument strings thereabout, a thumb piece coupled to the tapered shaft by an adjustable angle coupler which permits the thumb piece to be selectively orientated at a desired rotational angle relative to the tapered shaft, wherein the thumb pieces of the instrument can all be positioned at a desired orientation.

In these respects, the repositionable tuning peg according to the present invention substantially departs from the conventional concepts and designs of the prior art, and in so doing provides an apparatus primarily developed for the purpose of tuning a stringed instrument and permitting the thumb pieces of the instrument to be positioned at a desired orientation.

SUMMARY OF THE INVENTION

In view of the foregoing disadvantages inherent in the known types of tuning devices now present in the prior art, the present invention provides a new repositionable tuning peg construction wherein the same can be utilized for tuning a stringed instrument and permitting the thumb pieces of the instrument to be positioned in a desired orientation. As such, the general purpose of the present invention, which will be described subsequently in greater detail, is to provide a new repositionable tuning peg apparatus and method which has many of the advantages of the tuning devices mentioned heretofore and many novel features that result in a repositionable tuning peg which is not anticipated, rendered obvious, suggested, or even implied by any of the prior art tuning devices, either alone or in any combination thereof.

To attain this, the present invention generally comprises a tapered shaft for receiving one of the instrument strings thereabout. A thumb piece is coupled to the tapered shaft by an adjustable angle coupler which permits the thumb piece to be selectively orientated at a desired rotational angle relative to the tapered shaft. By this structure, the thumb pieces of the instrument can all be positioned at a desired orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new repositionable tuning peg apparatus and method which has many of the advantages of the tuning devices mentioned heretofore and many novel features that result in a repositionable tuning peg which is not anticipated, rendered obvious, suggested, or even implied by any of the prior art tuning devices, either alone or in any combination thereof.

It is another object of the present invention to provide a new repositionable tuning peg which may be easily and efficiently manufactured and marketed.

It is a further object of the present invention to provide a new repositionable tuning peg which is of a durable and reliable construction.

An even further object of the present invention is to provide a new repositionable tuning peg which is susceptible of a low cost of manufacture with regard to both materials and labor, and which accordingly is then susceptible of low prices of sale to the consuming public, thereby making such repositionable tuning pegs economically available to the buying public.

Still yet another object of the present invention is to provide a new repositionable tuning peg which provides in the apparatuses and methods of the prior art some of the advantages thereof, while simultaneously overcoming some of the disadvantages normally associated therewith.

Still another object of the present invention is to provide a new repositionable tuning peg for tuning a stringed instrument.

Yet another object of the present invention is to provide a new repositionable tuning peg which includes a tapered shaft for receiving one of the instrument strings thereabout, a thumb piece coupled to the tapered shaft by an adjustable angle coupler which permits the thumb piece to be selectively oriented at a desired rotational angle relative to the tapered shaft.

Even still another object of the present invention is to provide a new repositionable tuning peg which permits the thumb pieces of the instrument to all be positioned in a desired orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
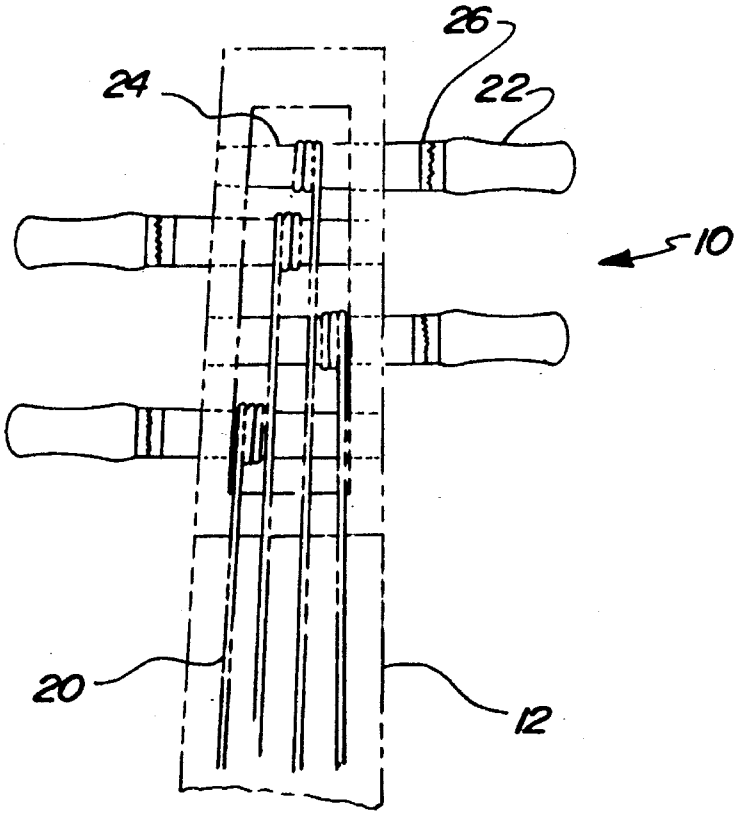
FIG. 2 is a front illustration view of a stringed instrument including repositionable tuning pegs according to the present invention.

With reference now to the drawings, and in particular to FIGS. 1–4 thereof, a new repositionable tuning peg embodying the principles and concepts of the present invention and generally designated by the reference numeral 10 will be described.

Figure 1:
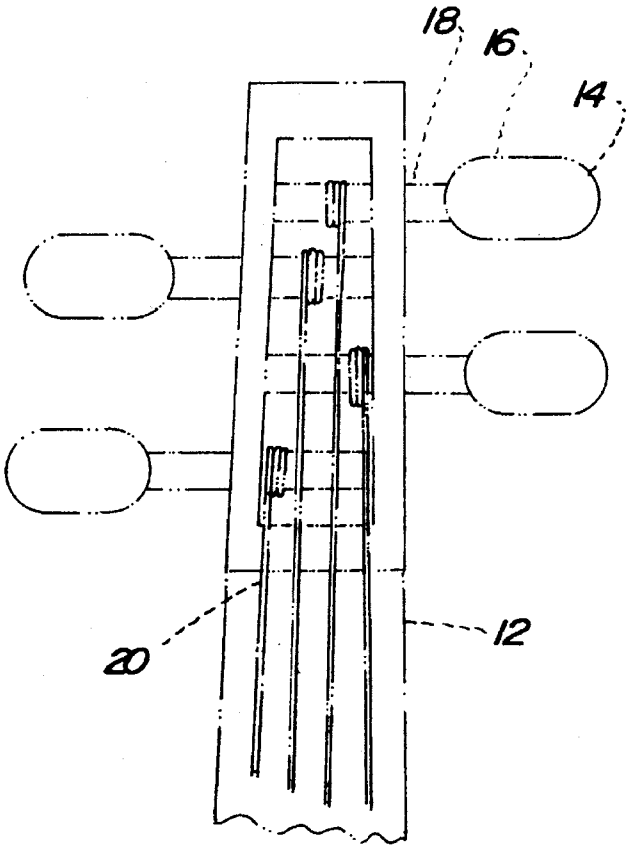
Fig. 1 PRIOR ART
FIG. 1 is a front elevation view of a stringed instrument including a conventional solid tuning peg.

Referring initially now to FIG. 1, it can be shown that a conventional stringed instrument 12 typically includes a solid tuning peg 14 having a solid tuning peg thumb piece 16 fixedly secured to a solid tuning peg tapered shaft 18 which projects through the neck of the stringed instrument 12 and receives an individual one of the strings 20 thereabout to effect tightening or tensioning of such string. Because the solid tuning peg thumb piece 16 is fixedly secured to the solid tuning peg tapered shaft 18, the thumb pieces of the stringed instrument 12 are commonly positioned at a variety of angles, as illustrated in FIG. 1. When the solid tuning peg thumb pieces are positioned parallel to the neck of the stringed instrument 12, as illustrated for three of such solid tuning pegs 14 in FIG. 1, it is difficult to effect rotation of the solid tuning peg due to the limited clearance between adjacent solid tuning peg thumb pieces 16.

Referring now to FIG. 2, it can be shown that the repositionable tuning peg 10 according to the present invention includes a repositionable thumb piece 22 coupled to a tapered shaft 24 by an adjustable angle coupling means 26 which permits the thumb piece 22 to be selectively oriented at a desired rotational angle relative to the tapered shaft. By this structure, the thumb pieces 22 of the stringed instrument 12 can be selectively and uniformly positioned at a desired angle. Preferably, it is desirable to position the thumb pieces perpendicularly relative to the neck, as shown in FIG. 2.

Figure 3:
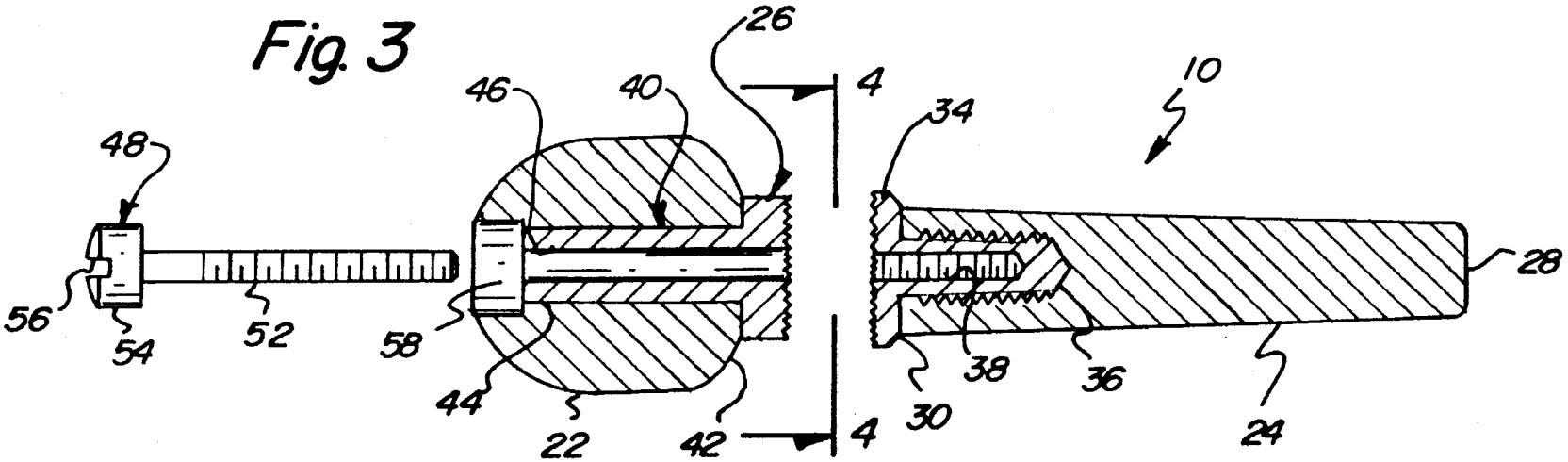
FIG. 3 is a cross sectional view of the present invention.

Referring now to FIG. 3, the repositionable tuning peg 10 of the present invention is illustrated in detail. The device 10 more specifically comprises the tapered shaft 24 which includes a first end 28 tapering to a second end 30. The tapered shaft 24 is substantially circular in cross section, with the first end 28 having a first end diameter and the second end 30 having a second end diameter, wherein the second end diameter is substantially slightly larger than the first end diameter. Although not shown in the cross section illustration of FIG. 3, the tapered shaft 24 additionally includes string engaging means for coupling the string 20 of the stringed instrument 12 thereto, whereby such string can then be wrapped around the tapered shaft as it is rotated. The string engaging means may comprise a string bore extending into the tapered shaft 24 and orientated at an orthogonal orientation relative to a longitudinal axis of the shaft.

The repositionable tuning peg 10 further comprises the thumb piece 22 which is coupled to the second end 30 of the tapered shaft 24 and angularly adjustable relative to the tapered shaft. To this end, the thumb piece 22 is joined to the second end 30 of the tapered shaft 24 by an adjustable angle coupling means 26 which permits such selective angular orientation thereof. The adjustable angle coupling means 26 comprises a shaft insert 32 which is fixedly secured to the second end 30 of the tapered shaft 24. The shaft insert 32 comprises a first circular plate 34 having an exposed exterior face and a covered interior face, with a first mounting stud 36 projecting from the interior face of the first circular plate and into the second end 30 of the tapered shaft 24. The first mounting stud 36 is threaded into the tapered shaft 24, and is preferably additionally secured to the tapered shaft by a suitable adhesive. The first mounting stud 36 includes a threaded interior bore 38 extending through a center of the first circular plate 34 along a longitudinal axis of the tapered shaft 24, as best illustrated in FIG. 3.

With continuing reference to FIG. 3, it can be shown that the adjustable angle coupling means 26 further comprises a thumb piece insert 40 which extends through the thumb piece 22 and comprises a second circular plate 42 having an exposed exterior face and a covered interior face, with a second mounting stud 44 projecting from the interior face of the second circular plate. The second mounting stud 44 extends through the thumb piece 22 and includes an unthreaded interior bore 46 through which a threaded fastener 48 can rotatably extend. The thumb piece insert 40 may be frictionally engaged to the thumb piece 22, but is preferably additionally coupled to the thumb piece by an adhesive or the like.

Figure 4:
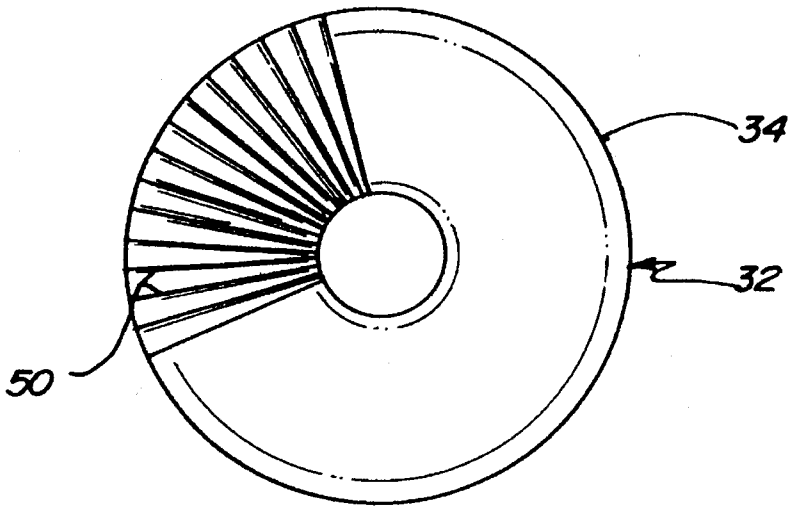
FIG. 4 is an elevation view taken from line 4—4 off FIG. 3.

Referring now to FIG. 4, it can be shown that the circular plates 34, 42 each include a plurality of radially extending ridges 50 which extend from a center of the plate to an outer perimeter thereof, as illustrated for the first circular plate 34 for example. The ridges 50 formed along the exterior face of the first circular plate 34 are cooperable with the ridges 50 formed along the exterior face of the second circular plate 42 to preclude rotational motion of the thumb piece 22 relative to the tapered shaft 24 when such ridges are cooperatively engaged. To effect engagement of the first circular plate ridges 50 against the second circular plate ridges 50, the threaded fastener 48 extends through the unthreaded bore 46 of the thumb piece insert 40 and threadably engages the threaded interior bore 38 of the shaft insert 32. The threaded fastener 48 includes a threaded shank 52 having exterior threads cooperable with the threaded interior bore 38, as well as a head 54 having a slot 56 allowing for reception of a tool such as a screwdriver or the like to effect rotation of the threaded fastener 48 as desired. The thumb piece 22 may also be provided with a counter sunk bore 58 which receives the head 54 of the threaded fastener 48 to provide a streamlined appearance of the device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A repositionable tuning peg comprising:

a tapered shaft having a first end spaced from a second end;

a thumbpiece;

and, an adjustable angle coupling means for coupling said thumbpiece to said second end of said tapered shaft at a desired rotational angle relative to said tapered shaft;

wherein said adjustable angle coupling means comprises a shaft insert fixedly secured to said second end of said tapered shaft; a thumb piece insert fixedly secured to said thumb piece; and means to removably couple said shaft insert to said thumb piece insert;

and further wherein said shaft insert comprises a first circular plate having an exposed exterior face and a covered interior face, with a first mounting stud projecting from said interior face of said first circular plate and into said second end of said tapered shaft, said first mounting stud including a threaded interior bore extending through a center of said first circular plate and along a longitudinal axis of said tapered shaft.

2. The repositionable tuning peg of claim 1, wherein said thumb piece insert comprises a second circular plate having an exposed exterior face and a covered interior face, with a second mounting stud projecting from said interior face of said second circular plate, said second mounting stud extending through said thumb piece and including an unthreaded interior bore.

3. The repositionable tuning peg of claim 2, wherein said means to removably couple said shaft insert to said thumb piece insert comprises a threaded fastener extending through said unthreaded bore threadably engaging said threaded interior bore of said shaft insert.

4. The repositionable tuning peg of claim 3, wherein said exterior faces of said circular plates each include a plurality of radially extending ridges which extend from a center of each plate to an outer perimeter thereof, wherein said ridges formed along said exterior face of the first circular plate cooperate with said ridges formed along said exterior face of said second circular plate to preclude rotational motion of said thumb piece relative to said tapered shaft when said ridges are cooperatively engaged.

5. A repositionable tuning peg comprising:

a tapered shaft having a first end spaced from a second end, said tapered shaft being substantially circular in cross section and including a first end tapering to a second end, said first end having a first end diameter and said second end having a second end diameter, wherein said second end diameter is larger than said first end diameter;

a thumbpiece;

a shaft insert fixedly secured to said second end of said tapered shaft, said shaft insert comprising a first circular plate having an exposed exterior face and a covered interior face, with a first mounting stud projecting from said interior face of said first circular plate and into said second end of said tapered shaft, said first mounting stud including a threaded interior bore extending through a center of said first circular plate and along a longitudinal axis of said tapered shaft;

a thumb piece insert fixedly secured to said thumb piece, said thumb piece insert comprising a second circular plate having an exposed exterior face and a covered interior face, with a second mounting stud projecting from said interior face of said second circular plate, said second mounting stud extending through said thumb piece and including an unthreaded interior bore;

and, means to removably couple said shaft insert to said thumb piece insert, said means comprising a threaded fastener extending through said unthreaded bore threadably engaging said threaded interior bore of said shaft insert.

6. The repositionable tuning peg of claim 5, wherein said exterior faces of said circular plates each include a plurality of radially extending ridges which extend from a center of each plate to an outer perimeter thereof, wherein said ridges formed along said exterior face of the first circular plate cooperate with said ridges formed along said exterior face of said second circular plate to preclude rotational motion of said thumb piece relative to said tapered shaft when said ridges are cooperatively engaged.

* * * * *